US007758381B2

(12) United States Patent
Oki

(10) Patent No.: US 7,758,381 B2
(45) Date of Patent: Jul. 20, 2010

(54) CAGE WITH A FINGER IN CONTACT WITH HOST PANEL AND PLUGGABLE TRANSCEIVER, AND A CAGE ASSEMBLY INCLUDING THE CAGE AND THE PLUGGABLE TRANSCEIVER

(75) Inventor: Kazushige Oki, Yokohama (JP)

(73) Assignee: Sumitomo Electric Industries, Ltd., Osaka-shi (JP)

( * ) Notice: Subject to any disclaimer, the term of this patent is extended or adjusted under 35 U.S.C. 154(b) by 0 days.

(21) Appl. No.: 12/341,562

(22) Filed: Dec. 22, 2008

(65) Prior Publication Data

US 2009/0176409 A1 Jul. 9, 2009

(30) Foreign Application Priority Data

Jan. 7, 2008 (JP) ..... 2008-000469

(51) Int. Cl.
*H01R 13/648* (2006.01)

(52) U.S. Cl. ..... 439/607.28; 439/607.17

(58) Field of Classification Search .....
439/607.01–607.59, 108; 385/92
See application file for complete search history.

(56) References Cited

U.S. PATENT DOCUMENTS

| | | | | |
|---|---|---|---|---|
| 5,207,597 | A * | 5/1993 | Kline et al. | 439/607.38 |
| 5,549,481 | A * | 8/1996 | Morlion et al. | 439/108 |
| 6,368,153 | B1 | 4/2002 | Hwang | |
| 6,416,361 | B1 | 7/2002 | Hwang | |
| 6,454,603 | B2 * | 9/2002 | Casey et al. | 439/607.28 |
| 6,478,622 | B1 * | 11/2002 | Hwang | 439/607.2 |
| 7,281,864 | B2 * | 10/2007 | Mizue et al. | 385/92 |
| 7,491,090 | B2 * | 2/2009 | Oki et al. | 439/607.17 |
| 7,530,845 | B1 * | 5/2009 | Yang | 439/607.01 |
| 2006/0140552 | A1 * | 6/2006 | Mizue et al. | 385/92 |
| 2007/0207673 | A1 | 9/2007 | Oki et al. | |

FOREIGN PATENT DOCUMENTS

JP 2007-233261 A 9/2007

* cited by examiner

*Primary Examiner*—Chandrika Prasad
(74) *Attorney, Agent, or Firm*—Venable LLP; Michael A. Sartori; Steven J. Schwarz

(57) ABSTRACT

A new arrangement of the cage for the pluggable optical transceiver is disclosed. The cage provides a plurality of fingers which has a corrugated shape with first and second contact portion. The first contact portion comes in contact with the front panel of the host system when the cage is implemented therein, while, the second contact portion comes in contact with the housing of the transceiver when it is set within the cage.

7 Claims, 5 Drawing Sheets

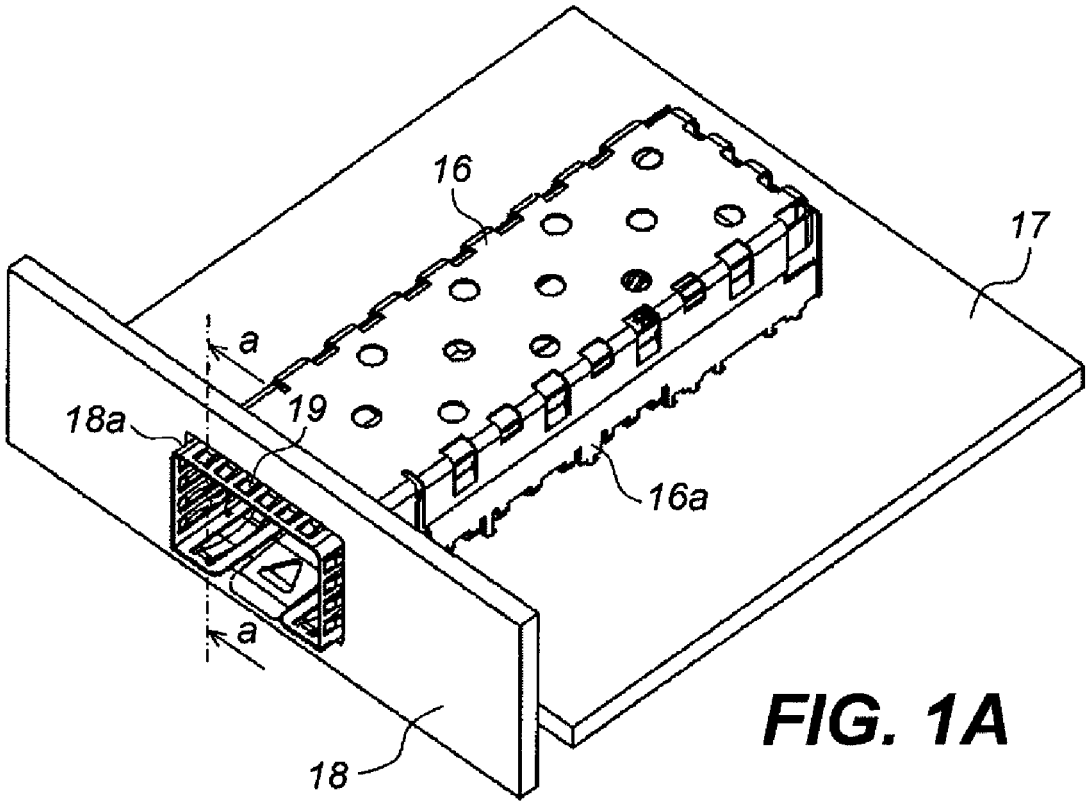
FIG. 1A
FIG. 1B
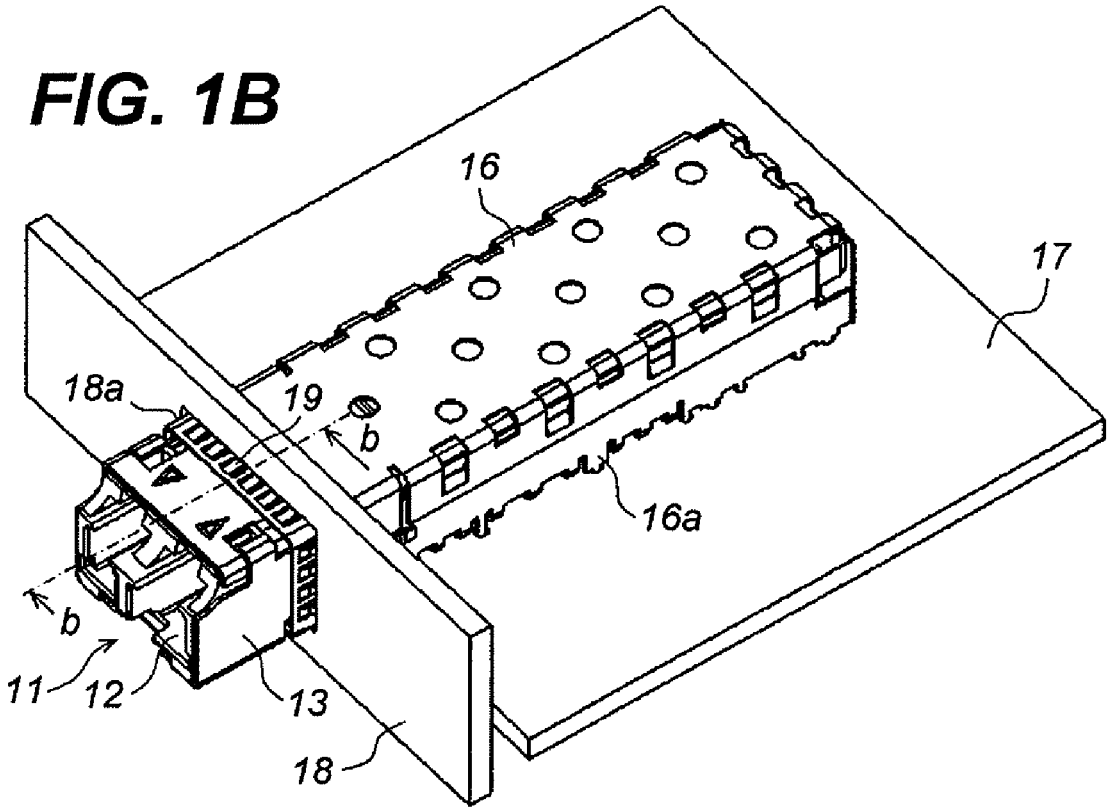

FIG. 4A
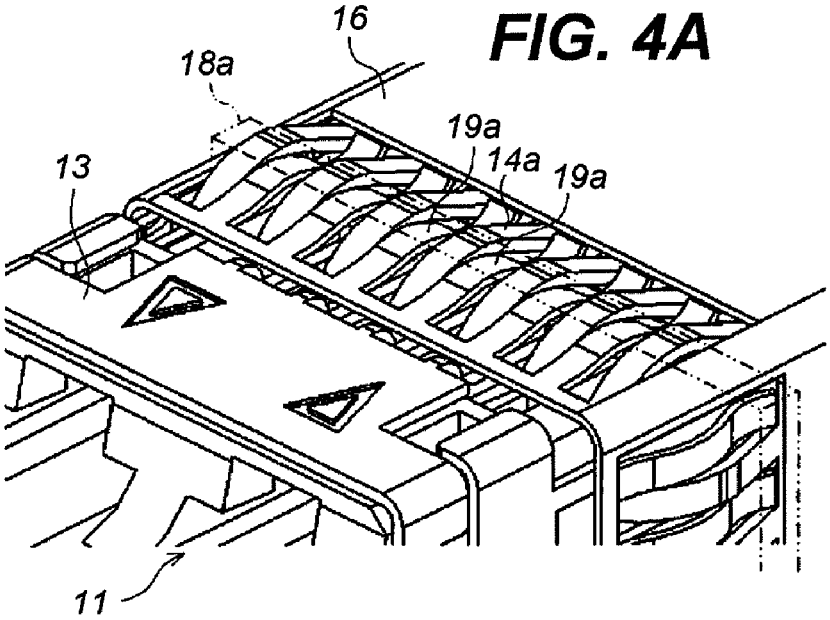
FIG. 4B
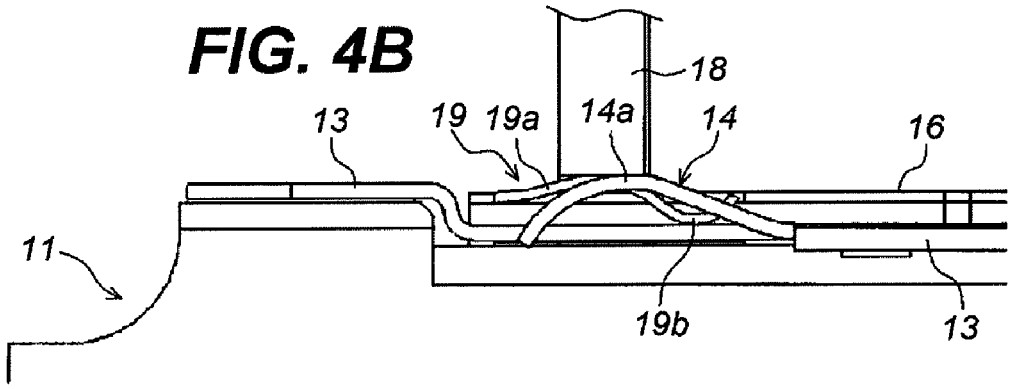
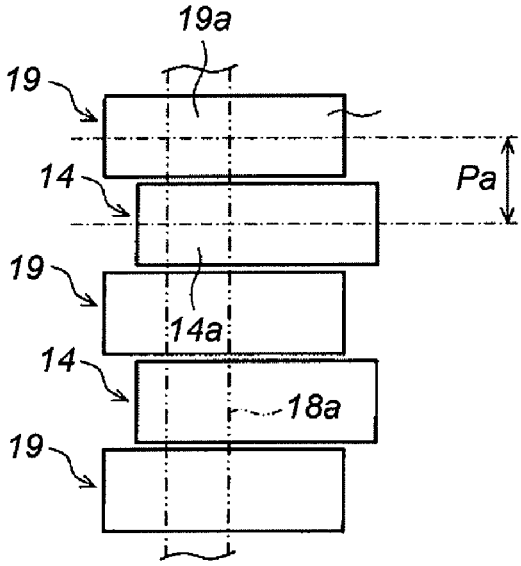
FIG. 4C
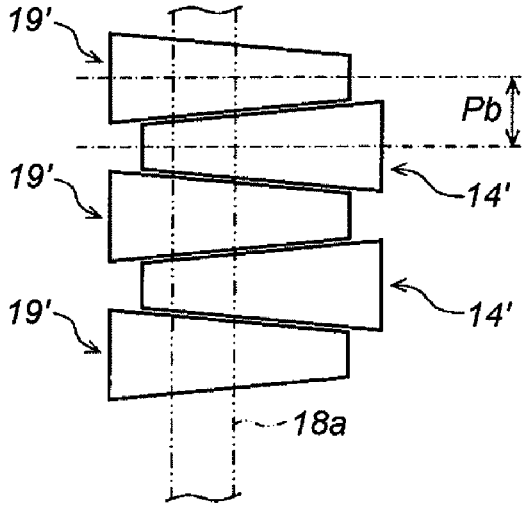
FIG. 4D

CAGE WITH A FINGER IN CONTACT WITH HOST PANEL AND PLUGGABLE TRANSCEIVER, AND A CAGE ASSEMBLY INCLUDING THE CAGE AND THE PLUGGABLE TRANSCEIVER

BACKGROUND OF THE INVENTION

1. Field of the Invention

The present invention relates to a cage that receives a pluggable optical transceiver and an assembly of the cage with the transceiver.

2. Related Prior Art

The pluggable optical transceiver generally provides a light-emitting device and a light-receiving device to communicate optically with optical fibers. The light-emitting device and the light-receiving device are installed in an optical receptacle, while, an electronic circuit electrically connected with those optical devices are installed in the body portion. The pluggable transceiver is to be repeatedly set within a cage made of metal and communicates with the host system that mounts the cage by mating the electrical plug provided in the rear end of the optical transceiver with the electrical connected implemented with the deep end of the cage.

The housing of the transceiver is preferably conductive because, when it is set within the metal cage, the electrically conductive housing accompanied with the metal cage may reduce the EMI radiation from the host system by securely grounding the housing and the cage. A Japanese Patent Application published as JP-2007-233261A has disclosed a type of the grounding architecture where an elastic finger, a ground finger, provided in the metal cover of the transceiver comes in contact with the inner surface of the cage pushed by the optical connecter inserted within the optical recepticle of the tansceiver, while, when the receptacle is free from the optical connector, the elastic finger becomes apart from the cage to facilitate the extraction of the transceiver from the cage.

The U.S. Pat. No. 6,368,153, has disclosed another type of the cage finger, in which the cage provides two types of fingers, one of which protrudes from the peripheral walls outwardly to come in contact with the front panel, while, the other type of the finger protrudes inwardly to come in contact with the transceiver. The cage provides these two types of fingers in plural to secure the plurality of ground path to the host system and to the transceiver.

FIG. 5 illustrates a detail of the cage disclosed in the U.S. Pat. No. 6,368,153. The cage provides a plurality of fingers 9 in the peripheral walls, 6*a* to 6*d*, in the front end portion. These fingers 9 are, for instance, divided into two portions, one of which is bent outwardly 9*a*, while, the other of which is bend inwardly 9*b*. The former finger 9*a* comes in contact with the front panel of the host system, while, the latter finger 9*b* comes in contact with the transceiver when the transceiver is set within the cage.

Generally, in order to set the optical transceiver on the host system through the cage by taking the EMI shielding performance into account, it is necessary not only to stabilize the ground by securely connecting the cage with the front panel and with the cage with fingers but to narrow the gap between the front panel and the cage, between the cage and the transceiver, and between the fingers in the cage to be coming in contact with the front panel or with the transceiver.

Receiver optical communication increases the transmission speed thereof and is now going to exceed 10 Gbps. In such high frequencies, the characteristic wavelength becomes shorter such that a gap with a less dimension may leak the EMI radiation. The fingers of the cage that protrudes outwardly or inwardly may partially fill the gap between the front panel and the cage, that between the cage and the housing of the transceiver. However, the finger arrangement such as shown in FIG. 5 where the outward finger and the inward winger are formed in side-by-side leaves some gaps between the fingers, which probably leak the EMI radiation. Thus, it is necessary to fill the gap not only between the cage and the front panel, and between the cage and the transceiver but also the gaps between the fingers, or to narrow the gaps between the fingers as possible.

The present invention is to provide a new arrangement of the cage finger that enables to narrow the gaps between fingers in addition to make the ground contact at a plurality of points.

SUMMARY OF THE INVENTION

One aspect of the present invention relates to an arrangement of the cage mounted on the board of the host system such that the front end thereof exposes from the front panel of the host system to receive a pluggable optical transceiver with an electrically conductive surface. A feature of the cage according to the invention is that the cage provides a plurality of cage fingers each having a first contact portion and a second contact portion. The first contact portion comes in electrically contact with the front panel, while, the second contact portion comes in electrically contact with the housing of the transceiver. In the cage finger of the present invention, the first contact portion and the second contact portion are continuously formed to each other as a single limb.

The first contact portion may constitute a root portion of the limb, while, the second contact portion may constitute an end portion of the limb. Each of the cage fingers may have a corrugated cross section with the first contact portion as a crest and the second contact portion as a trough.

Another aspect of the present invention relates to a cage assembly that comprises a cage and a pluggable optical transceiver. The cage, made of electrically conductive material and mounted on a board of the host system with a front panel, has a plurality of cage fingers each having a first contact portion and a second contact portion continuously formed with respect to the first contact portion as a single limb. The pluggable optical transceiver, which is set within the cage, has an electrically conductive housing with a plurality of ground fingers. A feature of the present cage assembly is that the first contact portion comes in electrically contact with the front panel of the host system, while, the second contact portion comes in electrically contact with the housing.

Each of the ground fingers comes in contact with the cage at a portion between the cage fingers, or each of the ground fingers comes in contact with the front panel by passing between the cage fingers. Moreover, each of the cage fingers may have a tapered shape with a narrower width in an end portion thereof, and each of the ground fingers may have a tapered shape with a narrower width in an end portion thereof. In the present invention, the cage fingers and the ground fingers may be nested to each other.

BRIEF DESCRIPTION OF DRAWINGS

FIG. 1A illustrates a cage according to an embodiment of the invention, and FIG. 1B illustrates a cage assembly comprising the cage shown in FIG. 1A and a pluggable optical transceiver set within the cage;

FIGS. 4A and 4B are a perspective view and a side cross section of cage assembly according to another embodiment of the invention, respectively, where the ground finger comes in contact with the front panel by passing between the cage fingers, and FIGS. 4C and 4D are plan views of the cage finger and the ground finger nested to each other.

DESCRIPTION OF PREFERRED EMBODIMENTS

Figure 2A:
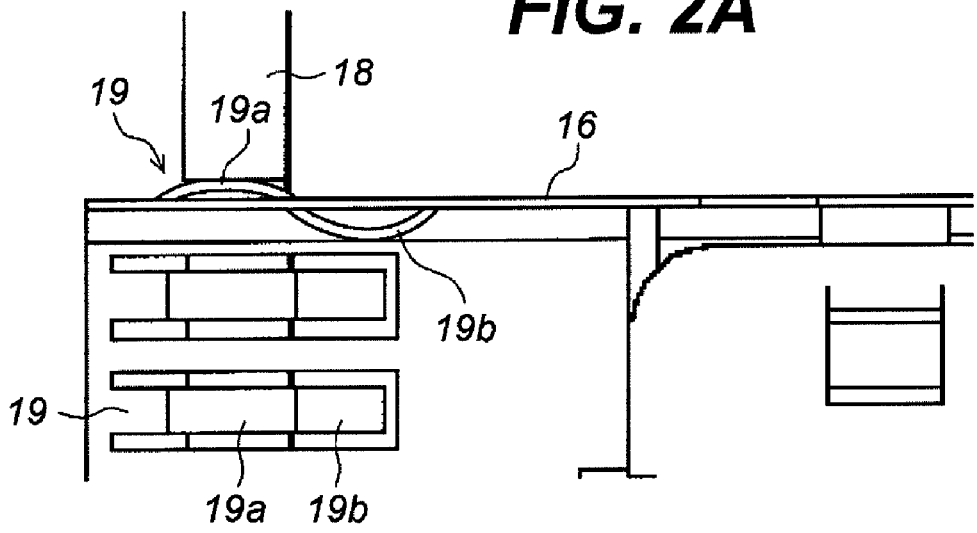
FIG. 2A is a cross section, which is taken along an axis a-a shown in FIG. 1A, magnifies a cage finger being in contact with the front panel also with the pluggable optical transceiver set within the cage.
Figure 2B:
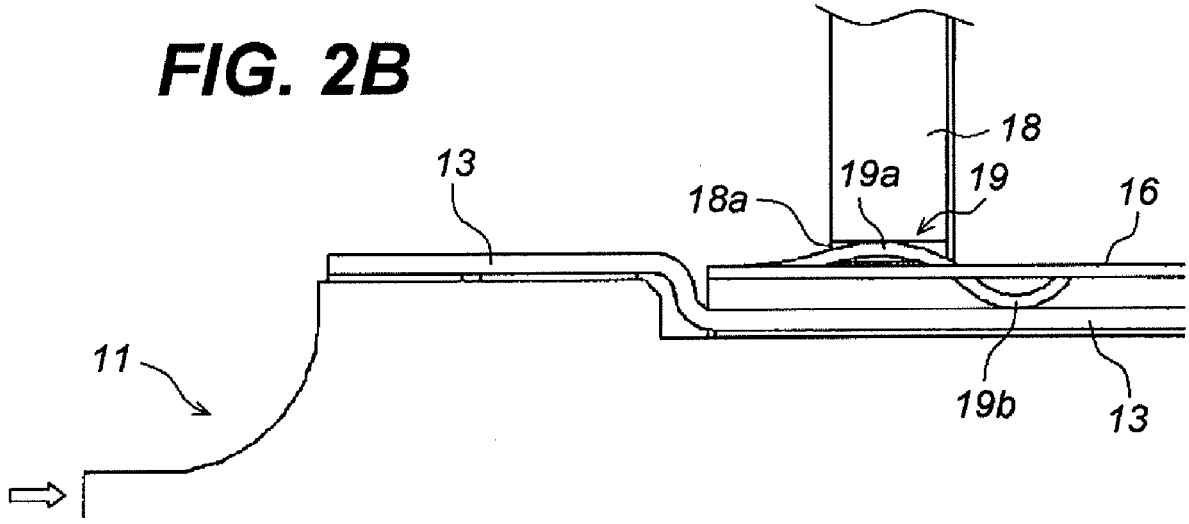
FIG. 2B is a cross section taken along an axis b-b shown in FIG. 1B.

Next, preferred embodiments of the present invention will be described as referring to accompanying drawings. FIG. 1A illustrates a cage 16 implemented in the host board 17, while, FIG. 1B illustrates an optical transceiver 11 set in the cage 16. FIG. 2A shows a cross section taken along the line a-a in FIG. 1A, while, FIG. 2B shows a cross section taken along the line b-b in FIG. 1B. The optical transceiver 11 includes an optical receptacle 12 and a body 13.

As illustrated in FIG. 1A, on the host board 17 is provided with the cage 16 that sets the optical transceiver 11 therein such that a plurality of stud pins 16*a* is inserted within the via holes in the host board 17 and is soldered to the ground pattern. Thus, the cage is grounded. The front end of the cage is exposed from the opening 18*a* of the front panel 18 of the host system. The cage 16, which is made of meal sheet, includes a plurality of fingers 19 in the front portion thereof.

The fingers 19 of the cage come in contact with the edges of the opening 18*a*. Thus, the cage is also grounded through the front panel of the host system. The cage finger 19 includes a first contact portion 19*a* and a second contact portion 19*b*. The first contact portion 19*a* extrudes outwardly to come in contact with the inner edge of the opening 18*a*.

Referring to FIG. 1B, the cage 16 receives the optical transceiver 11 such that the electrical plug provided in the rear end of the transceiver mates with the electrical connected provided in the deep end of the cage, where FIG. 1B does not illustrates both the electrical plug and the electrical connector. The optical transceiver 11 includes an optical receptacle 12 in the front portion thereof that receives and mates with an optical connector, and a body portion continuous to the receptacle 12 that is protected with a metal cover, which is not shown in the figures.

The optical transceiver 11 is set in the cage such that the receptacle 12 exposes and protrudes from the front panel 18, that is, the receptacle 12 protrudes from the front panel 18. When the transceiver 11 is set within the cage 16, the second contact portion 19*b* of the cage finger 19 comes in contact with at least the inner surface of the top and the side of the cage 16.

FIG. 2A shows a cross section and the plan view of the finer 19. The cage finger 19 is formed by cutting the side and the top surface of the cage 16 with a U-shape and bending an inner portion of the cut portion twice. That is the cut portion is firstly bent outward in a root portion thereof to form the first contact portion 19*a* and secondly bend inward in an end portion thereof to form the second contact portion 19*b*. Thus, the cage finger 19 shows the corrugated cross section.

FIG. 2B illustrates a cross section where the transceiver 11 is set in the cage 16. The first contact portion 19*a* of the cage finger 19 elastically comes in contact with the inner edge of the opening 18*a* in the front panel, while, the second contact portion 19*b* elastically comes in contact with the housing 13 of the transceiver 11. Thus, the cage 16 may make an electrical contact with the front panel 18 and with the housing 13 of the transceiver 11 with the single cage finger 19.

The cage finer 19 is preferably to have numbers of narrower limbs compared with a case where the cage 16 provides less numbers of wider limbs, because the wider limb, although it is able to fill the gap, is difficult to maintain the homogeneous electrical contact with the front panel 18 and with the housing 13 of the transceiver along the lateral direction. The plurality of narrower limbs makes it possible to secure the electrical contact with the others in many points and this configuration may stabilize the ground potential and enhance the EMI shielding.

Because the first and the second contact portions, 19*a* and 19*b*, of the cage finger 19 according to the present invention are formed continuously along the longitudinal direction of the cage finger 19, not only the width thereof but the pitch along the lateral direction may be narrowed. Thus, the electrical contact points between the cage finger 19 and the front panel 18 and between the cage finger 19 and the housing 13 of the transceiver 11 may be increased to stabilize the ground potential. Moreover, the narrowed gap between the fingers 19 may enhance the EMI shielding at higher frequencies.

Figure 3A:
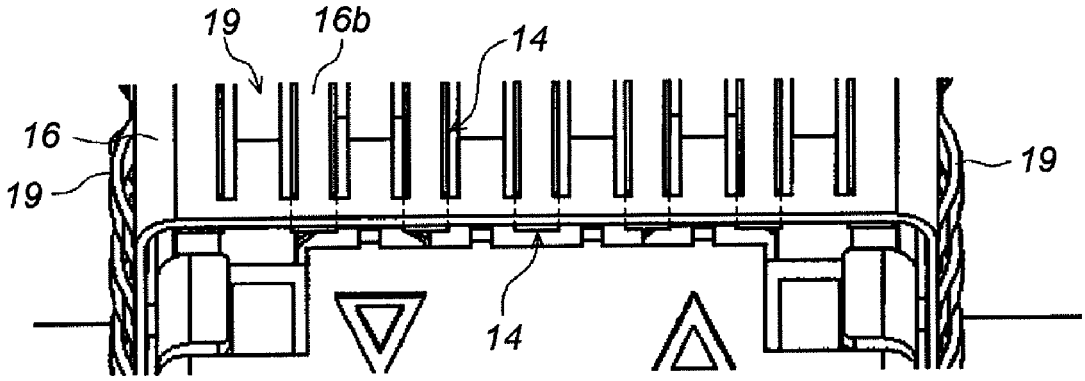
FIGS. 3A and 3B are a perspective view and a side cross section of the cage assembly according to an embodiment of the invention, respectively, where the cage finger comes in contact with the front panel and the pluggable transceiver, while, the ground finger of the pluggable transceiver comes in contact with the inner surface of the cage.
Figure 3B:
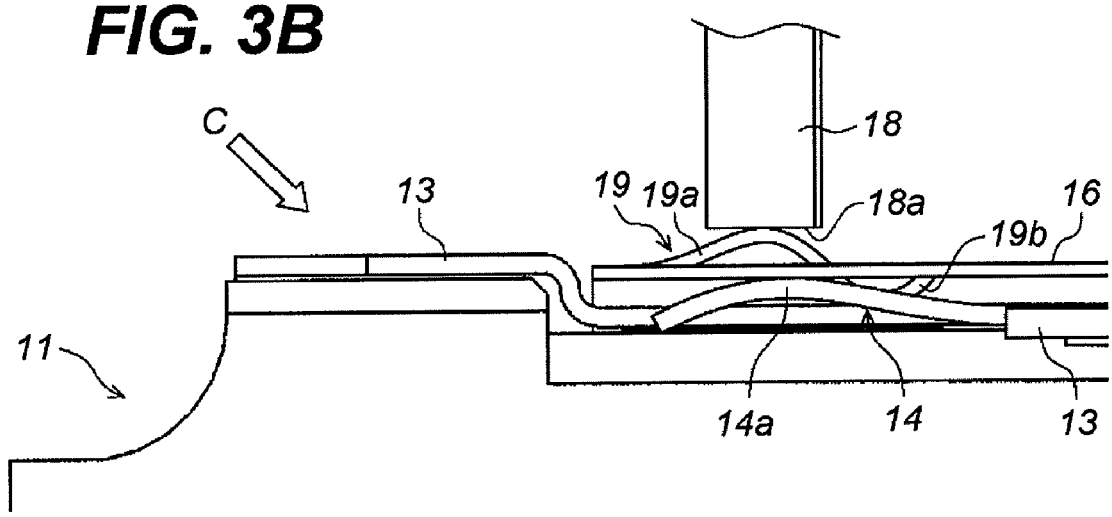
Figure 5A:
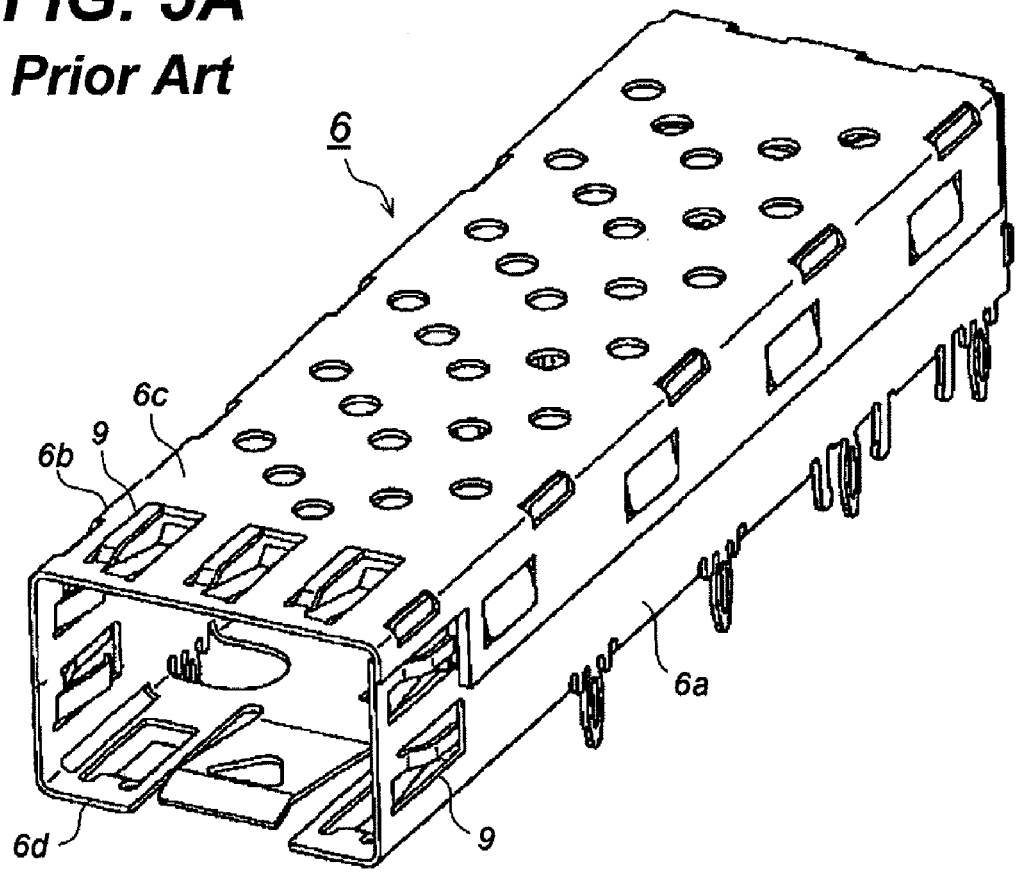
FIG. 5A Prior Art
FIGS. 5A and 5B shows a cage with cage fingers according to the conventional arrangement.
Figure 5B:
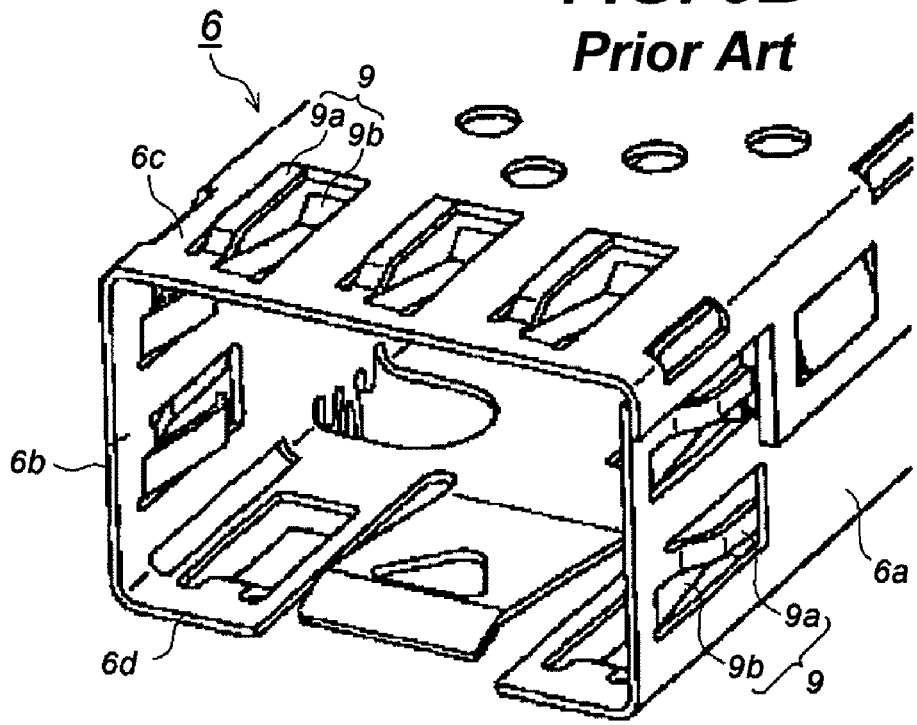
FIG. 5B Prior Art

FIGS. 3A and 3B illustrate another embodiment of the cage finger 19. FIG. 3A is a perspective drawing viewed from the direction C marked in FIG. 3B. In this embodiment, the ground finger 14 provided with the housing 13 of the transceiver 11 comes in contact with an inner surface between fingers 19 of the cage 16. Similar to the first embodiment, the first contact portion 19*a* comes in contact with the inner edge 18*a* of the opening 18, while, the second contact portion 19*b* comes in contact with the housing 13 of the transceiver 11 to stabilize the ground potential.

The ground finger 14 provides with the housing 13 is formed by cutting the housing 13 in the U-shape and bending the cut portion outwardly. The ground finger 14 in the bent portion 14*a* thereof comes in contact with the portion 16*b* between the fingers 19 of the cage 16. Thus, the housing 13 of the transceiver 11 and the cage 16 are able to be doubly contact with respect to each other, one of which is between the second contact portion 19*b* and the housing 13, the other of which is between the bent portion 14*a* of the ground finger 14 and the inner wall of the cage, to secure the ground path from the housing 13 to the cage 16 in further stable.

FIGS. 4A and 4B show still another embodiment of the present invention. FIG. 4A is a perspective view, while, FIG. 4B is a cross section taken along the longitudinal direction. FIGS. 4C and 4D show examples of the arrangement of the cage finger 19 and the ground finger 14. This embodiment shown in FIGS. 4A to 4D remove the portions between the fingers 19 appeared in the last embodiment shown in FIGS. 3A and 3B, while, the root portions of respective limbs are remained as they are unified with the cage such that the cage fingers 19 forms a comb shape. The ground finger 14 of the housing 13 protrudes between the limbs outwardly.

The ground finger 14 protruding from the gap between limbs in the contact portion 14*a* thereof comes in contact with the inner edge 18*a* of the opening 18 to secure the ground potential, while, the cage finger 19 comes in contact with the inner edge 18*a* of the opening by the first contact portion 19*a* thereof and in contact with the housing 13 by the second portion 19*b* as described in the former embodiment. Thus, the cage finger 19 and the ground finger 18 come in contact with the inner edge 18*a* of the opening 18 alternately to secure the plurality of current path between the front panel 18 and the cage and between the front panel 18 and the housing 13. This arrangement may further enhance the EMI shielding performance.

The cage finger 19 and the ground finger 14 may have a tapered shape as shown in FIG. 14D. That is, the finger, 14 or 19, narrows the width thereof as close to the free end so as to nest to each other. When the pitch between two fingers is Pa when the shape of respective fingers is rectangular and that between fingers with the tapered shape is Pb, then the Pb may be less than Pa as shown in FIGS. 4C and 4D, which enables to increase the number of fingers and to narrow the gap between fingers.

Additional modifications and improvements of the present invention may also be apparent to those of ordinary skill in the art. Thus, the particular combination of parts described and illustrated herein is intended to represent only certain embodiments of the present invention, and is not intended to serve as limitations of alternative devices within the spirit and scope of the invention.

What is claimed is:

1. A cage that is mounted on a board of a host system such that a front end of said cage exposes from an opening formed in a front panel of said host system to receive a pluggable optical transceiver that has an electrically conductive housing, said front panel being made of electrical conductive material, wherein said cage provides a plurality of cage fingers each having a first contact portion and a second contact portion, said first contact portion coming in contact with said front panel and said second contact portion coming in contact with said pluggable optical transceiver, wherein said first contact portion and said second contact portion are continuously formed as a single limb, and wherein said cage finger has a corrugated cross section, said first contact portion forming a crest of said corrugated cross section to come in elastically contact with an edge of said opening of said front panel and said second contact portion forming a trough of said corrugated cross section to come in elastically contact with said electrically conductive housing of said optical transceiver.

2. The cage according to claim 1, wherein said first contact portion constitutes a root portion of said limb and said second contact portion constitutes an end portion of said limb.

3. A cage assembly, comprising:

a cage made of electrically conductive material and mounted on a board of a host system having a front panel with an opening, said cage having a plurality of cage fingers each having a first contact portion and a second contact portion continuously formed from said first contact portion as a single limb; and a pluggable optical transceiver set within said cage and having a housing made of electrically conductive material, said housing providing a plurality of ground fingers, wherein said first contact portion comes in electrically contact with said front panel of said host system and said second contact portion comes in electrically contact with said housing of said pluggable optical transceiver, and wherein each of said cage fingers has a corrugated cross section, said first contact portion forming a crest of said corrugated cross section to come in elastically contact with an edge of said opening of said front panel and said second contact portion forming a trough of said corrugated cross section to come in elastically contact with said housing of said optical transceiver.

4. The cage assembly according to claim 3, wherein said first contact portion constitutes a root portion of said limb and said second contact portion constitutes a tip portion of said limb.

5. The cage assembly according to claim 3, wherein each of said ground fingers comes in contact with said cage at a portion between said cage fingers.

6. The cage assembly according to claim 3, wherein each of said ground fingers comes in contact with said front panel of said host system by passing between said cage fingers.

7. The cage assembly according to claim 6, wherein each of said cage fingers has a tapered shape with a narrower width in an end portion thereof, and each of said ground fingers has a tapered shape with a narrower width in an end portion thereof, and wherein said cage fingers and said ground fingers are nested to each other as arranging said end portion of said cage fingers and said end portion of said ground fingers alternately.

* * * * *